US007146760B2

(12) United States Patent
Yiu

(10) Patent No.: US 7,146,760 B2
(45) Date of Patent: Dec. 12, 2006

(54) APPARATUS FOR DISPLAYING AN ILLUMINATED OBJECT

(75) Inventor: Lau Man Yiu, Hong Kong (HK)

(73) Assignee: Patty Barron, Alpharetta, GA (US)

( * ) Notice: Subject to any disclaimer, the term of this patent is extended or adjusted under 35 U.S.C. 154(b) by 55 days.

(21) Appl. No.: 10/774,542

(22) Filed: Feb. 9, 2004

(65) Prior Publication Data

US 2005/0172532 A1 Aug. 11, 2005

(51) Int. Cl.
*A47G 1/06* (2006.01)

(52) U.S. Cl. ..... 40/743; 40/714; 312/114

(58) Field of Classification Search ..... 40/714, 40/574, 564, 800, 743; 312/114, 126, 128
See application file for complete search history.

(56) References Cited

U.S. PATENT DOCUMENTS

| | | | | | |
|---|---|---|---|---|---|
| 1,480,375 | A | | 1/1924 | Cristadoro | |
| 2,220,262 | A | | 11/1940 | Miller | 240/4 |
| 2,529,713 | A | | 11/1950 | Thurston | 240/4 |
| 2,549,928 | A | * | 4/1951 | Reefe | 40/714 |
| 2,727,327 | A | | 12/1955 | Colby | 41/21 |
| 2,840,228 | A | * | 6/1958 | Takacs | 206/769 |
| 3,318,032 | A | | 5/1967 | Robinson et al. | 40/152.2 |
| 3,503,147 | A | * | 3/1970 | Herrin et al. | 40/800 |
| 4,155,608 | A | * | 5/1979 | Orlewicz | 312/204 |
| 4,353,327 | A | * | 10/1982 | Shroyer | 119/257 |
| 4,424,449 | A | * | 1/1984 | O'Brill | 250/461.1 |
| 4,819,353 | A | * | 4/1989 | Glucksman et al. | 40/716 |
| 4,835,661 | A | | 5/1989 | Fogelberg et al. | 362/97 |
| 4,942,685 | A | | 7/1990 | Lin | 40/152.2 |
| 5,251,391 | A | * | 10/1993 | Lan | 40/714 |
| 5,265,357 | A | | 11/1993 | Yu | 40/152.2 |
| 5,313,724 | A | * | 5/1994 | Warner | 40/714 |
| 5,371,656 | A | | 12/1994 | Iorfida | 362/31 |
| 5,408,771 | A | | 4/1995 | Manrubia | 40/152.2 |
| 5,426,573 | A | * | 6/1995 | Jenkins | 362/154 |
| 5,546,687 | A | | 8/1996 | Iorfida | 40/546 |
| 5,555,654 | A | * | 9/1996 | Hermann | 40/714 |
| 5,657,563 | A | | 8/1997 | Lane | 40/219 |
| 5,806,223 | A | * | 9/1998 | Visagie | 40/800 |
| 5,896,690 | A | * | 4/1999 | Suesholtz | 40/743 |
| 6,732,462 | B1 | * | 5/2004 | Kramer | 40/800 |
| 6,776,505 | B1 | * | 8/2004 | DeWitt | 362/249 |
| 2002/0133993 | A1 | | 9/2002 | Mueller | 40/714 |

* cited by examiner

*Primary Examiner*—Gary C. Hoge
(74) *Attorney, Agent, or Firm*—Merchant & Gould

(57) ABSTRACT

An illuminated display apparatus comprising a frame member and a housing for containing a three-dimensional object is disclosed. The illuminated display apparatus further includes a light source mounted within the housing for illuminating the object contained within the housing of the apparatus. It is noted that this abstract is provided to comply with the rules requiring an abstract that will allow a searcher or other reader to ascertain quickly the subject matter of the technical disclosure and is not be used to interpret or limit the scope or meaning of the claims.

16 Claims, 6 Drawing Sheets

APPARATUS FOR DISPLAYING AN ILLUMINATED OBJECT

BACKGROUND OF THE INVENTION

1. Field of the Invention

The present invention relates generally to a lighted display apparatus and, more particularly, to a lighted display apparatus for containing and illuminating three-dimensional objects.

2. Background

Illuminating pictures displayed within a frame is often desired because illumination makes details of the pictures more pronounced, especially when lighting in the room where the pictures are displayed is insufficient. Framed pictures can be lighted externally by closely positioned or attached light fixtures or internally by light fixtures incorporated inside the picture frame itself. Frames are typically constructed to house such things as canvases, photographs, and paper, but not three-dimensional objects such as vases and figurines. Instead, display cases are normally used to exhibit three-dimensional objects. Display cases can also be internally illuminated by a light fixture, but the light fixture often insufficiently illuminates the objects maintained within the display case because the light fixture typically consists of a light bulb mounted above the objects, which causes top portions of the objects to receive direct light while bottom portions of the objects receive little or on light.

There is a need for an apparatus for displaying and sufficiently illuminating three-dimensional objects.

SUMMARY OF THE INVENTION

The present invention relates to a lighted display apparatus for containing and illuminating three-dimensional objects. One exemplary embodiment of the present invention comprises a frame including an interior side, an inner perimeter, and a center opening defined by the inner perimeter. The illuminated display apparatus also includes a housing mounted to the frame and extending outward from the interior side of the frame. The housing includes a rear wall, a side member having opposing ends, and a recessed area defined by the rear wall and the side member. The recessed area has a depth sufficient for containing a three-dimensional object. To protect the three-dimensional object, a transparent plate is located within the center opening of the frame. The illuminated display apparatus preferably further comprises a light source mounted within the housing and a power source conductively connected to the light source for illuminating the object.

DETAILED DESCRIPTION OF THE PREFERRED EMBODIMENT

The present invention is more particularly described in the following examples that are intended as illustrative only since numerous modifications and variations therein will be apparent to those skilled in the art. As used in the specification and in the claims, "a," "an," or "the" can mean one or more, depending upon the context in which it is used. The preferred embodiment is now described with reference to the figures, in which like numbers indicate like parts throughout the figures.

Figure 1A:
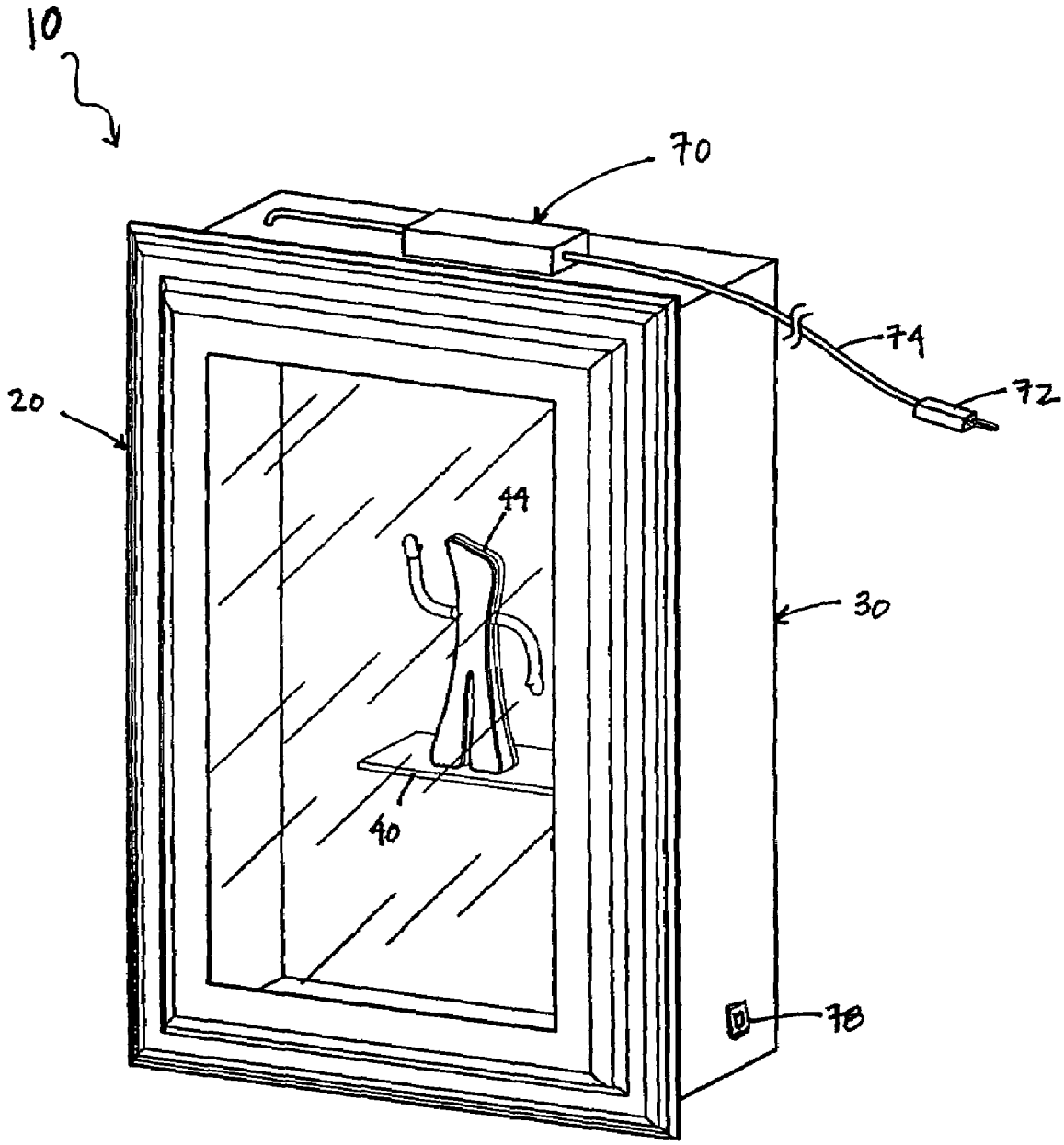
FIG. 1A is a perspective view of an illuminated display apparatus in accordance with one embodiment of the present invention.

Referring now to FIG. 1A, an illuminated display apparatus 10 according to the present invention is illustrated. One exemplary embodiment of the illuminated display apparatus 10 comprises a frame 20 and a housing 30. A three-dimensional object 44 displayed within the apparatus 10 is illuminated by a light source which receives power from a power source 70.

The frame 20 includes an ornate exterior side 22, an interior side 24, an inner perimeter 26, and a center opening 27 defined by the inner perimeter 26. The center opening 27 has a length and width sufficient to view the three-dimensional object 44 therethrough. The object 44 is contained within the housing 30 of the illuminated display apparatus 10.

Figure 1B:
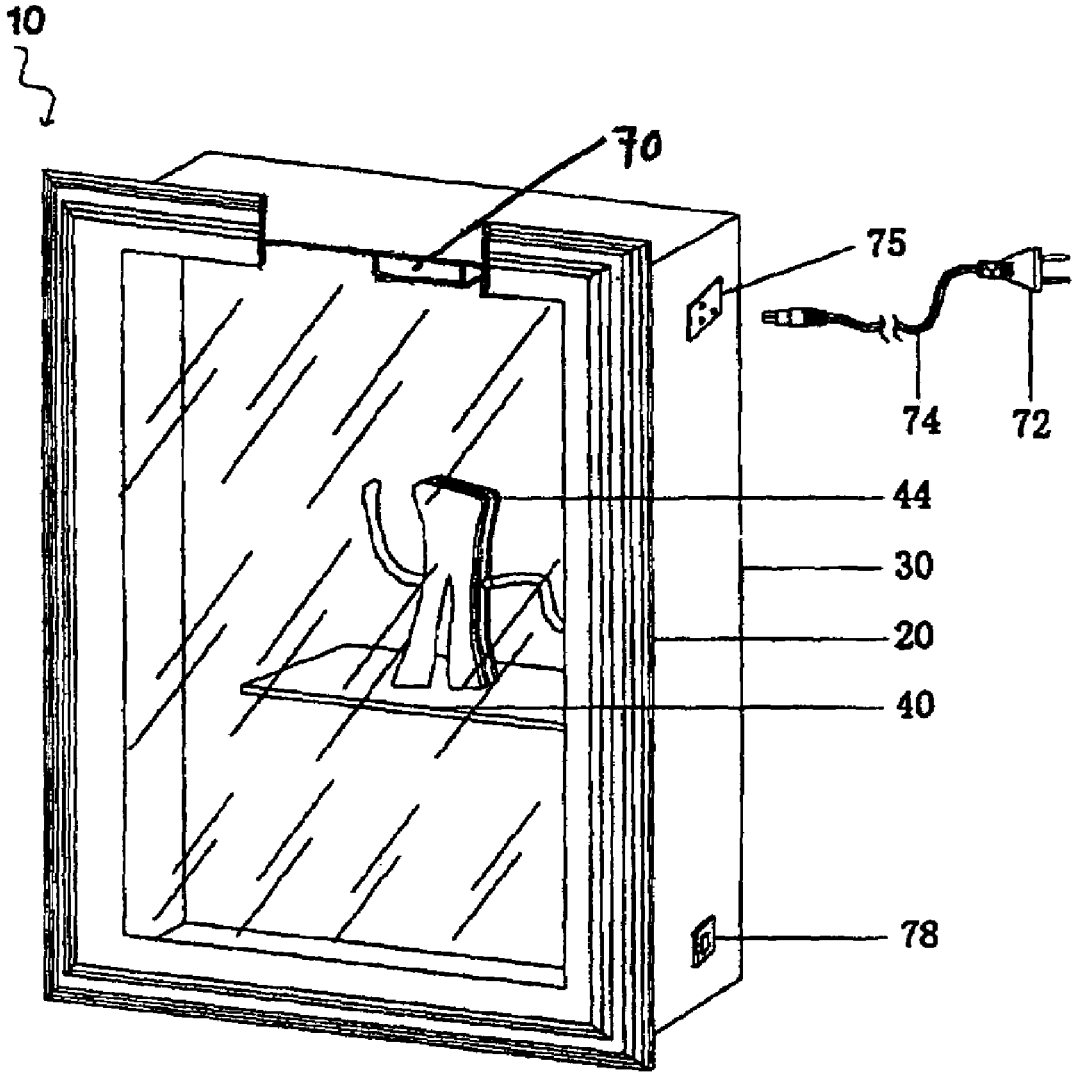
FIG. 1B is a perspective view of an illuminated display apparatus in accordance with another embodiment of the present invention.
Figure 2A:
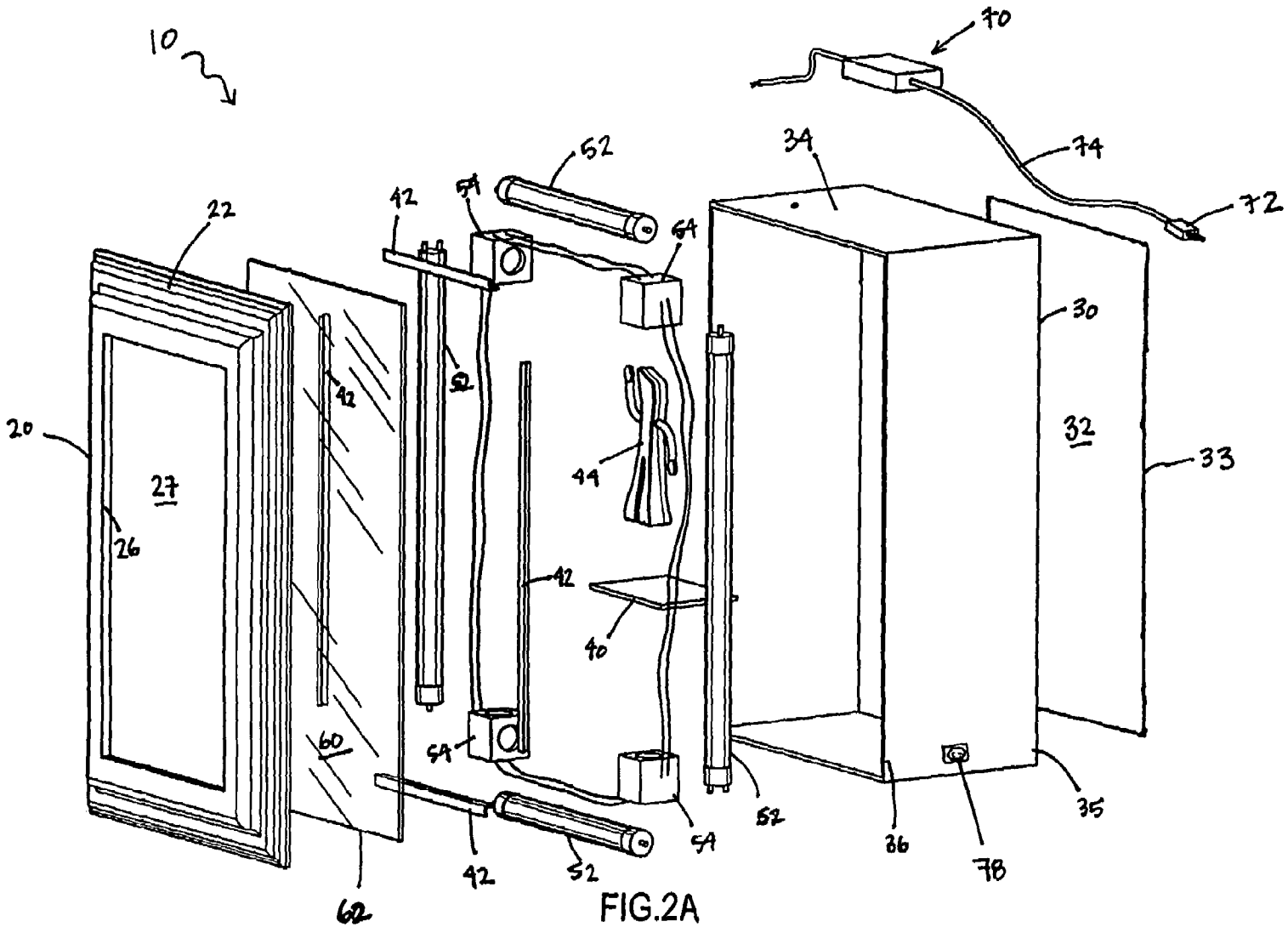
FIG. 2A is an exploded perspective of the illuminated display apparatus comprising a frame, a transparent plate, a housing, a light source, and a power source.

As illustrated in FIG. 2A, the housing 30 includes a rear wall 32 that has an edge 33 extending around the perimeter of the rear wall 32. The rear wall 32 is generally rectangular in shape, as illustrated in FIGS. 1–6, but it may be in a square, oval, circle, or any other shape if desirable. The rear wall 32 may also include a bracket attached to the back of the rear wall 32 for mounting the illuminated display apparatus 10 to a wall. As one skilled in the art will appreciate, however, a variety of conventional mounting means may be used to suspend the illuminated display apparatus 10 from a wall including hooks, chains, and adhesive materials.

The housing 30 further includes a side member 34 extending outward from the rear wall 32. The side member 34 has a first end 35 mounted coextensively to the edge 33 of the rear wall 32 and an opposing second end 36 disposed adjacent the interior side 24 of the frame 20. When mounted together, the rear wall 32 and the side member 34 define a recessed area 38 that has a depth sufficient to contain and display a three-dimensional object therein. The depth of the recessed area 38 may vary depending on the size and number of objects to be contained within the recessed area 38. The housing 30 preferably includes means of supporting the object 44 within the recessed area 38. As illustrated in FIGS.

Figure 3:
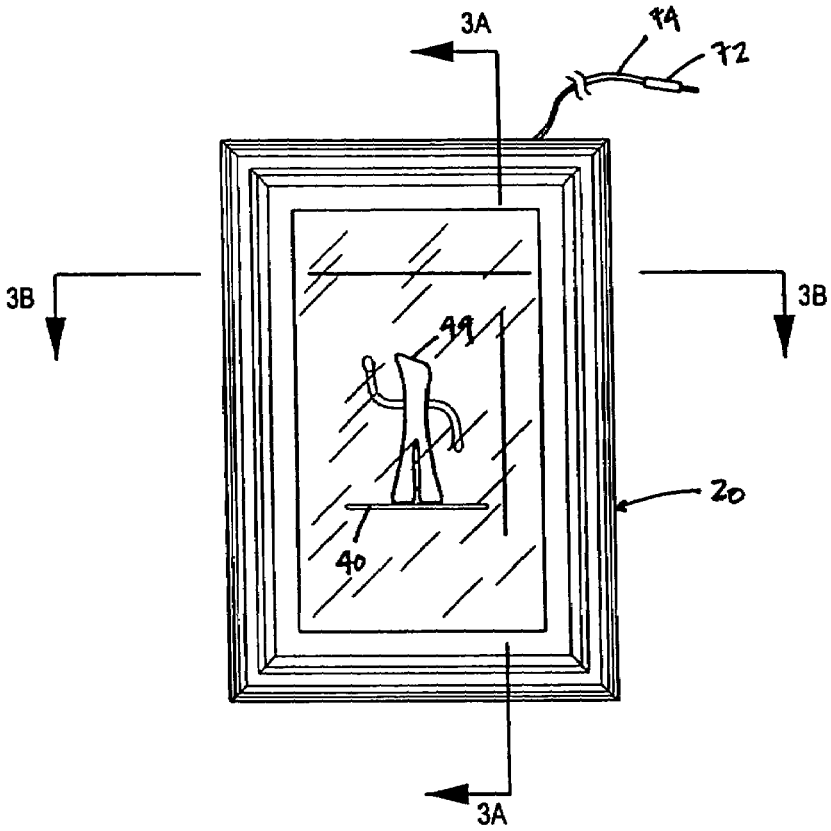
FIG. 3 is a front view of the illuminated display apparatus containing a three-dimensional object.
Figure 3A:
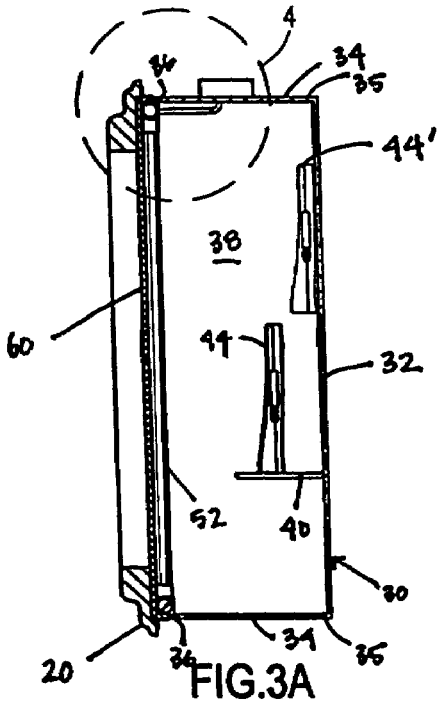
FIG. 3A is a sectional view taken through lines 3A—3A of FIG. 3 comprising an alternative means for supporting the three-dimensional object.
Figure 3B:
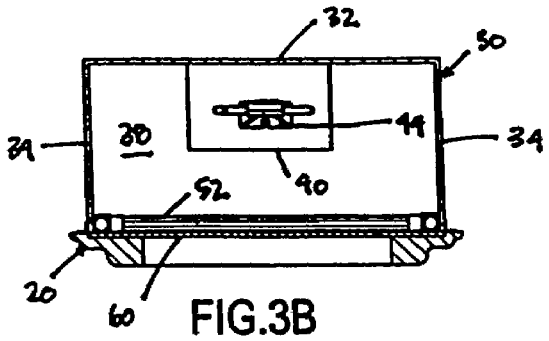
FIG. 3B is a sectional view taken through lines 3B—3B of FIG. 3.

3A–3B, the object 44 may be supported by a shelf 40 extending outward from the rear wall 32. The shelf 40 preferably has a depth less than the depth of the recessed area 38 of the housing 30. Alternatively, an object 44' may be supported by an adhesive material such as glue, Velcro, or tape which allows the object 44' to be mounted directly to the rear wall 32, as illustrated in FIG. 3A. As one skilled in the art will appreciate, however, a variety of supporting means may be used to mount the object 44 within the recessed area 38 of the housing 30.

As shown in FIG. 2A, the housing 30 preferably includes a plurality of brackets 42 mounted to opposing portions of the side member 34. The brackets 42 extend outward from the second end 36 of the side member 34 of the housing 30 and attach to the interior side 24 of the frame 20 such that the second end 36 of the side member 34 is disposed adjacent the interior side 24 of the frame 20. Other designs are contemplated to couple the housing 30 to the frame 20 including nails, screws, or chemical adhesives.

The apparatus 10 further includes a light source mounted within the recessed area 38 of the housing 30 for illuminating the object 44. As illustrated in FIG. 2A, the light source may be a plurality of cylindrical illumination bulbs 52, such as florescent lamps, having respective ends removably mounted within fittings 54 that are conductively connected in series. The fittings 54 are attached to the side member 34 of the housing within the recessed area 38 at locations that are selected to cause the bulbs 52 to extend around the side member 34 of the housing 30 adjacent the interior side 24 of the frame 20. As best shown in FIGS. 2A and 3, mounting the bulbs 52 around the side member 34 adjacent the interior side 24 allows light from the bulbs 52 to fully encompass the object 44 without the bulbs 52 being visible to a viewer. Alternatively, the fittings 54 may be attached to the side member 34 at locations that cause the bulbs 52 to extend around the inner perimeter 26 adjacent the rear wall 32 of the housing 30. The number of bulbs 52 needed to surround the inner perimeter 26 of the frame 20 will depend on the shape denoted by the rear wall 32.

Figure 2B:
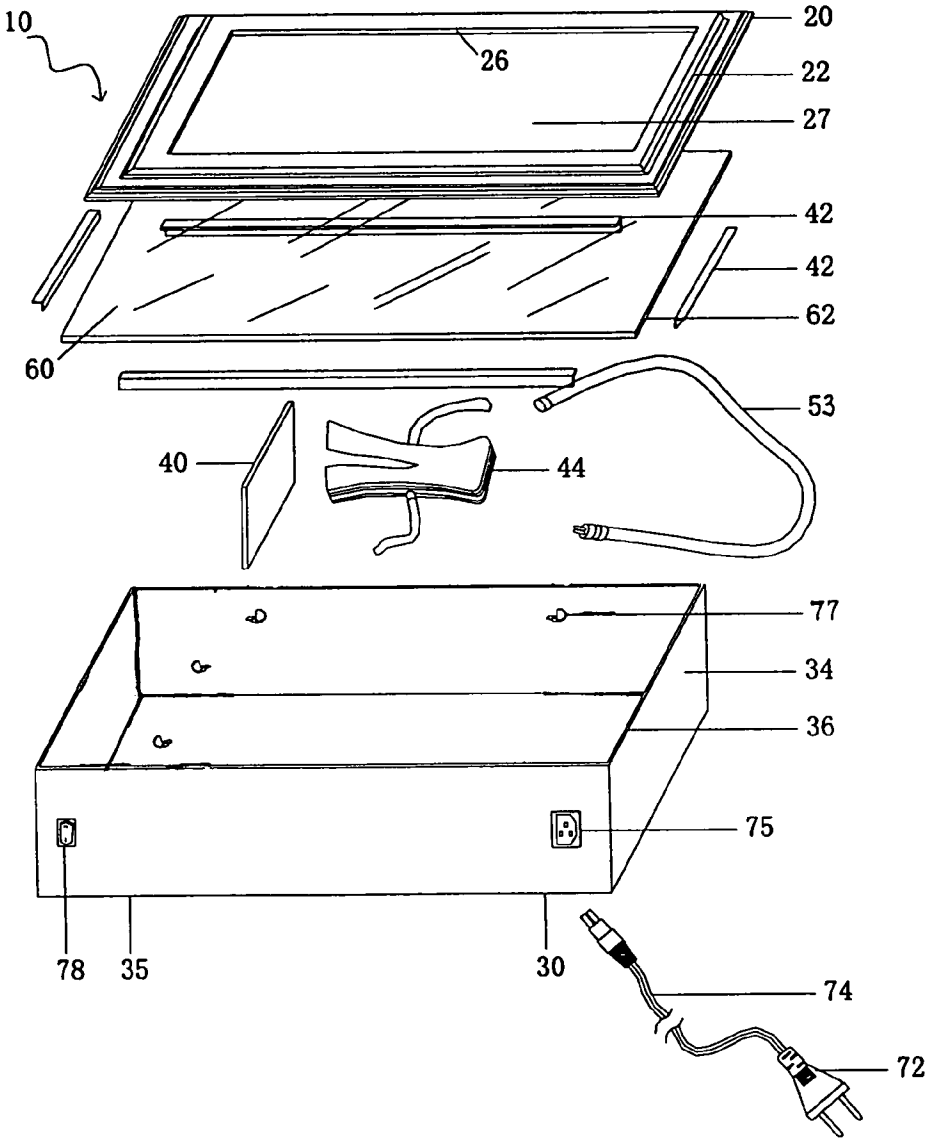
FIG. 2B is an exploded perspective of another embodiment of the illuminated display apparatus comprising a frame, a transparent plate, a housing, a light source, and a power source.

In another embodiment illustrated in FIG. 2B, the light source may be a flexible rope light 53 mounted within the recessed area 38 of the housing 30 adjacent to the interior side 24 of the frame 20 for illuminating the object 44. The rope light 53 is secured within the recessed area 38 by a plurality of fasteners 77. A power switch 78 for controlling the illumination of the light source may be positioned on the side member 34 of the housing 30 so that the power switch 78 is not visible to a viewer.

Figure 5:
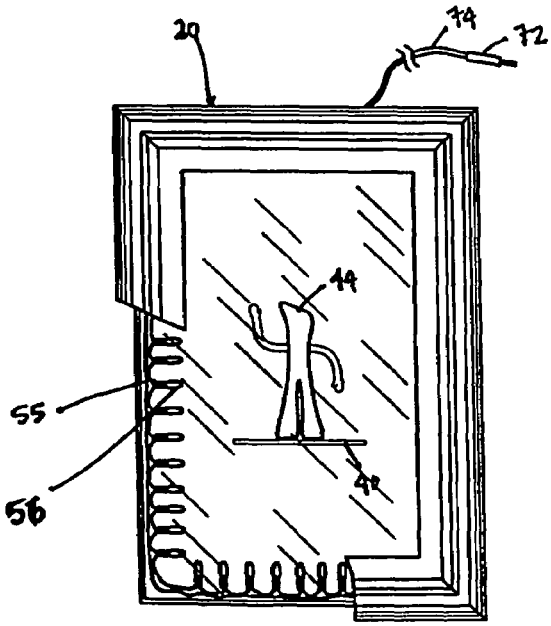
FIG. 5 is an elevation of the illuminated display apparatus showing one corner in section in order to illustrate an alternative light source, while the main part includes the frame.
Figure 6:
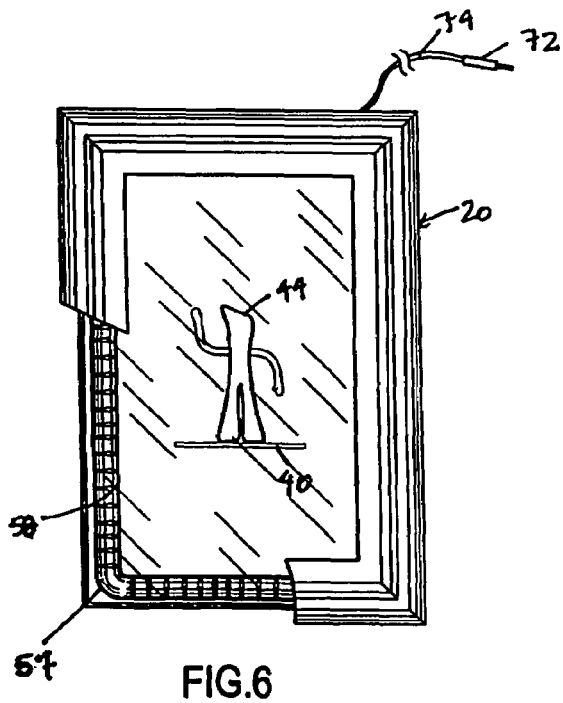
FIG. 6 is an elevation of the illuminated display apparatus showing one corner in section in order to illustrate an alternative light source, while the main part includes the frame.

In further embodiments, the light source may be a flexible light strip 55 comprising a plurality of illumination bulbs 56 conductively connected to each other, as shown in FIG. 5. The illumination bulbs may include conventional light bulbs, light emitting diodes (LEDs), or halogen bulbs. Similarly, a flexible light tube 57 comprising a plurality of illumination bulbs 58 conductively connected to each other encased by a heat resistant material for absorbing heat generated by the plurality of illumination bulbs 58, as illustrated in FIG. 6. Both the flexible light strip 55 and the flexible light tube 57 are preferably mounted to the side member 34 and extend around the side member 34 of the housing 30 adjacent to the interior side 24 of the frame 20.

As shown in FIG. 1A, a power source 70 for supplying electrical power to the light source may be mounted to the side member 34 of the housing 30 such that the power source 70 is not visible to a viewer. The power source 70 may include a battery compartment for holding at least one battery therein for supplying the electrical power. The power source may also contain an alternating current adaptor jack such that when an electrical cord 74 is conductively connected to the power source and a plug 72 is connected to a wall outlet, electric power is supplied to the light source therefrom, instead of from the at least one battery. Alternatively, as illustrated in FIG. 1B, the power source may be contained within the housing 30 of the illuminated display apparatus 10 such that the power source is not visible to a viewer. When the electric cord 74 is conductively connected to a power outlet 75 located on the side member 34 and the plug 72 is connected to a wall outlet, electric power is supplied to the light source therefrom.

Figure 4:
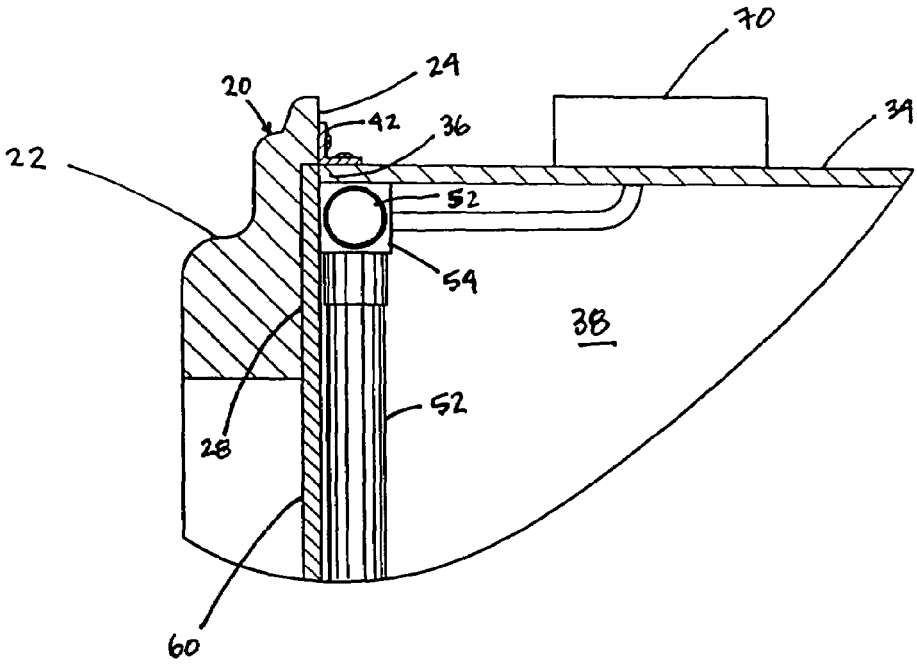
FIG. 4 is a partial sectional view of an embodiment according to the invention.

The illuminated display apparatus 10 also may include a transparent plate 60 located within the center opening 27 of the frame 20 to protect an object contained within the apparatus 10 from environmental impacts and viewers. The transparent plate 60 may be made from glass, acrylic, or another appropriate transparent material. To maintain the transparent plate 60 within the center opening 27, the transparent plate 60 preferably has a width and length greater than the width and length of the center opening 27. In a preferred embodiment, the transparent plate 60 has edges 62 that fit within a notch 28 that extends along the inner perimeter 26 of the frame 20, as best illustrated in FIG. 4. When the housing 30 and frame 20 are coupled together by the plurality of brackets 42, the transparent plate 60 is maintained within the notch 28 by the second end 36 of the side member 34 and by the fittings 54. Other means of retaining the transparent plate 60 within the center 27 of the frame 20 are contemplated including sliding the edges 62 of the transparent plate 60 within a groove extending along the inner perimeter 26 of the frame 20.

As described herein, an apparatus is provided for illuminating objects displayed within the apparatus. It will be appreciated by those skilled in the art that various modifications or variations may be made in the present invention without departing from the scope or spirit of the invention. Other embodiments of the invention will be apparent to those skilled in the art from consideration of the specification and practice of the invention disclosed herein.

I claim:

1. An illuminated display apparatus, comprising:

a frame member having an exterior side, an interior side, an inner perimeter, and a center opening defined by the inner perimeter;

a housing mounted to the frame member and extending outward from the interior side of the frame member, the housing including:

a rear wall, the rear wall having an edge extending around the perimeter of the rear wall;

a side member having opposing ends, the first end mounted to the edge of the rear wall and the second end disposed adjacent the interior side of the frame member; and a recessed area defined by the rear wall and the side member, wherein the recessed area has a depth sufficient for containing a three-dimensional object;

a light source mounted within the recessed area, the light source illuminating the three-dimensional object contained within the recessed area of the housing;

a transparent plate located within the center opening of the frame member, the transparent plate spaced apart from the rear wall of the housing, wherein the interior side of the frame member further comprises a notch portion for retaining the transparent plate, the notch portion extending along the inner perimeter of the frame member and the second end of the side member is disposed against the transparent plate to maintain the transparent plate in the notch portion of the frame member;

a shelf unit in the housing for supporting the three-dimensional object within the recessed area of the housing, the shelf unit being spaced inwardly from the side member and extending outwardly from and substantially perpendicular to the rear wall of the housing with a depth less than the depth of the recessed area; and a power source conductively connected to the light source for illuminating the light source.

2. The illuminated display apparatus of claim 1, wherein the shelf unit for supporting the three-dimensional object includes an adhesive material for mounting the object directly to the rear wall of the housing.

3. The illuminated display apparatus of claim 1, wherein the housing further comprises a plurality of bracket members for mounting the housing to the interior side of the frame member, wherein the plurality of bracket members are attached to the side member of the housing and extend outward from the second end of the side member.

4. The illuminated display apparatus of claim 1, wherein the light source extends around the side member of the housing and is attached to the side member of the housing adjacent the interior side of the frame member such that the light source is not visible to a viewer.

5. The illuminated display apparatus of claim 4, wherein the light source is at least one fluorescent lamp.

6. The illuminated display apparatus of claim 4, wherein the light source is a flexible light strip comprising a plurality of illumination bulbs conductively connected to each other and encased by a heat resistant material for absorbing heat generated by the plurality of illumination bulbs.

7. The illuminated display apparatus of claim 1, wherein the center opening of the frame member and the transparent plate each have a length and width, and wherein the length and width of the transparent plate are greater than the length and width of the center opening of the frame member.

8. The illuminated display apparatus of claim 7, wherein the inner perimeter of the frame member further comprises a groove portion for retaining the transparent plate, the groove portion extending along the inner perimeter of the frame member.

9. The illuminated display apparatus of claim 1, wherein the second end of the side member retains the transparent plate within the notch portion of the frame member.

10. The illuminated display apparatus of claim 1, wherein the transparent plate is a sheet of glass.

11. The illuminated display apparatus of claim 1, wherein the transparent plate is a sheet of acrylic.

12. The illuminated display apparatus of claim 1, wherein the power source is mounted on the side member of the housing within the recessed area such that the power source is not visible to a viewer.

13. The illuminated display apparatus of claim 12, further comprising an alternating current power supply for illuminating the light source through a wall outlet.

14. The illuminated display apparatus of claim 1, wherein the power source is mounted within the recessed area of the housing such that the power source is not visible to a viewer.

15. The illuminated display apparatus of claim 14, further comprising an alternating current power supply for illuminating the light source through a wall outlet.

16. The illuminated display apparatus of claim 1, wherein a portion of the frame member extends outward away from the center opening and beyond the side member, and wherein the power source is mounted to the side member behind the portion of the frame member extending outward away from the center opening and beyond the side member such that the power source is not visible to a viewer.

* * * * *